United States Patent [19]

Senor et al.

[11] Patent Number: 4,723,923

[45] Date of Patent: Feb. 9, 1988

[54] LOW INSERTION, STAMPED AND FORMED CONTACT SLEEVE

[75] Inventors: Ronald E. Senor, North Attleboro, Mass.; Luis A. Sousa, Cranston, R.I.

[73] Assignee: Augat Inc., Attleboro, Mass.

[21] Appl. No.: 904,384

[22] Filed: Sep. 5, 1986

[51] Int. Cl.[4] ..... H01R 13/11

[52] U.S. Cl. ..... 439/853; 439/874

[58] Field of Search ..... 339/258 R, 258 P, 275

[56] References Cited

U.S. PATENT DOCUMENTS

| | | | |
|---|---|---|---|
| 3,233,211 | 2/1966 | Smith | 339/258 R |
| 3,806,859 | 4/1974 | Madarasz | 339/258 R |
| 3,853,389 | 12/1974 | Occhipinti | 339/258 R |
| 3,864,004 | 2/1975 | Friend | 339/258 R |

*Primary Examiner*—Joseph H. McGlynn

*Attorney, Agent, or Firm*—Weingarten, Schurgin, Gagnebin & Hayes

[57] ABSTRACT

An improved electrical lead socket assembly is disclosed comprising a stamped and formed one-piece lead socket fabricated from a composite strip of at least two materials, at least one material having resilient mechanical characteristics, and at least one other material having different mechanical characteristics. The lead socket assembly may be further provided with superimposed strips of materials which have improved electrical conductivity characteristics or which are suitable for impeding the flow of solder.

12 Claims, 6 Drawing Figures

LOW INSERTION, STAMPED AND FORMED CONTACT SLEEVE

FIELD OF THE INVENTION

This invention relates to electrical connector apparatus and more particularly to a one-piece lead socket assembly stamped and formed from a composite strip material.

BACKGROUND OF THE INVENTION

Electrical interconnection boards, typically referred to as printed circuit, printed wiring or panel boards, normally have mounted onto them a plurality of electronic components such as dual-in-line ("DIP") electronic packages, which may be integrated circuit packages, or other types of electronic components formed with any number of leads. In some known devices, leads of electronic components are inserted into plated-through holes in the boards, which holes are electrically connected to various printed circuit paths on one or both sides of the board. Leads from the electronic devices would be individually soldered or collectively wave soldered so that the hole was filled with solder to permanently mount the component to the board and to make positive electrical interconnection with the printed circuit paths.

It is often desired to use the concept of plugability, that is, to be able to plug the leads of a component into a board for whatever purposes are desired and then to remove it if necessary. Such plugability is not possible with the method discussed above because the component leads are soldered to the printed circuit board. It is well-known, however, to provide a lead socket assembly in which one end is a lead receiving socket and the other end normally provides a solder tail or wire wrapping pin. See, for example, U.S. Pat. Nos. 4,186,990 and 4,296,549, assigned to the same assignee as named herein. The solder tail and wire wrapping pins project for some appreciable distance beyond the non-component side of the board and the lead receiving socket end normally projects a short distance beyond the other side of the board. The lead socket end is necessarily somewhat larger than might otherwise be desired because of the requirement that there be a tapered opening to facilitate inserting component leads and that there be an element within the socket assembly itself to frictionally engage the inserted component lead.

Prior known lead socket assemblies have been manufactured either by being machined or being stamped and formed. Machined socket assemblies have had certain deficiencies due to the fact that converging fingers of the lead socket contact are normally curved in a lateral direction with respect to their length, creating an inherent beam effect in the fingers which cause stresses to occur primarily at the point where the individual fingers are bent toward one another. That is, because of this beam configuration, the fingers are relatively stiff, so that flexing occurs primarily at the bending point rather than being distributed throughout the length of the fingers when a lead is inserted between them. In addition, because of the relative stiffness of the fingers, electrical component lead insertion and removal forces tend to be inconsistent from insert to insert over a period of time. Machined socket contacts also tend to be somewhat expensive. As examples of machined contacts, see U.S. Pat. Nos. 4,175,810 and 4,097,101, assigned to the same assignee as named herein.

Previous known lead socket assemblies which have also been stamped and formed out of strip metal have also faced certain disadvantages. These lead socket assemblies have been made of a single metal chosen to obtain a desired compromise as to strength, resiliency, cost and conductivity, depending on the particular characteristics preferred for the specific lead socket assembly. For example, where strength is considered to be a highly desired characteristic, the lead sockets have been made of a stronger material, thus trading off on other characteristics such as resiliency or cost. In addition, stamped and formed lead socket assemblies have not been preferred because it has been difficult to make stamped sockets perfectly round. Rather, they are substantially always somewhat egg-shaped, resulting in variable lead insertion and removal forces, and variability in physical and electrical contact.

While the prior art lead socket devices serve useful functions, their limitations have prevented their universal use where they otherwise might be the appropriate structure for various applications. Lead sockets therefore must preferably be capable of quickly and easily connecting and disconnecting with the leads of an electrical component without undue force. Each lead socket should also be able to provide excellent electrical conductivity and be capable of repeated connection and disconnection without damage or significant deterioration.

SUMMARY OF THE INVENTION

In accordance with the present invention, a one-piece lead socket assembly is provided which can be adapted to provide an inexpensive but mechanically strong lead socket assembly capable of placing high retention force on an electrical component lead, while at the same time providing good electrical contact. The disclosed lead socket assembly is designed to be stamped, formed and rolled out of a composite metal strip, one portion of which is comprised of a material chosen for its resiliency, such as beryllium copper, and the other portion of which is comprised of a different material chosen to provide a different mechanical or electrical characteristic than the first material. The second material is typically an inexpensive metal of relatively low strength, but high ductility, such as 190 alloy. Thus, with the disclosed invention, a lead socket assembly is provided which can use materials best suited for their particular applications, thus avoiding the necessary sacrifice in other characteristics in choosing one material for all purposes.

In the preferred embodiment, the composite strip metal is formed by continuously welding two metals together into the strip. A lead socket assembly blank is stamped from this composite strip and then rolled and formed into the desired lead socket assembly. The lead socket assembly blank can have axial slots stamped in the resilient metal portion so as to provide a set of equally spaced flexible fingers, each finger designed to extend as a cantilevered beam from its root in the lead socket and convergent towards the center of the lead socket. To improve the electrical conductivity of these fingers where they interface with an electrical component lead inserted into the lead socket, the fingers may be provided with a strip of high conductivity material, such as gold plate. In addition, to prevent solder applied to the tail of the lead socket assembly from creeping into the lead socket and thus interfering with the insertion or removal of a component lead, a strip of an anti-wicking material, such as aluminum, may be applied to the composite metal strip at a pre-chosen position prior to stamping, to cause a solder demarcation between the lead socket and its tail.

DESCRIPTION OF THE DRAWINGS

The invention will be more fully understood by reference to the detailed description of the invention in conjunction with the drawings, of which.

DETAILED DESCRIPTION OF THE INVENTION

Figure 1A:
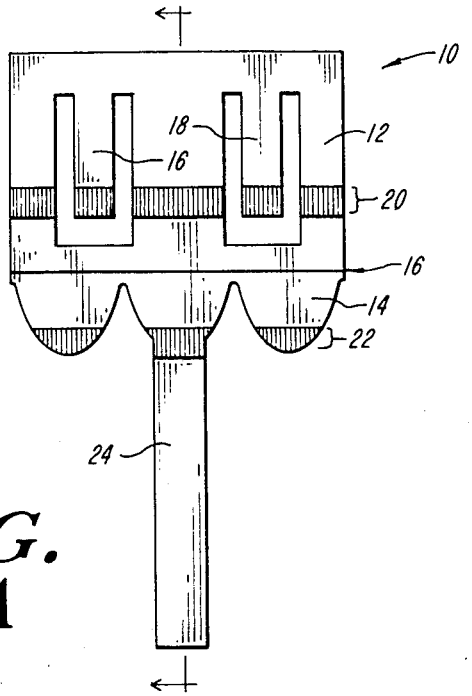
FIG. 1A is a plan view of a lead socket assembly blank which has been stamped from a composite sheet of metal.

In accordance with the present invention, an efficient and economic construction of a one-piece lead socket assembly is disclosed in which different portions of the lead socket assembly are comprised of materials particularly suited for the purposes those portions are intended to perform. Referring now to the drawings, there is shown an illustrative embodiment of the invention.

Figure 1B:
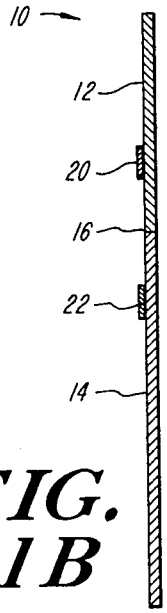
FIG. 1B is an edge view of the lead socket blank of FIG. 1A.

FIGS. 1A and 1B illustrate a lead socket assembly blank 10 which has been stamped from a composite metal strip for forming the connector. The blank 10 is comprised of an upper portion 12 of a resilient material, such as beryllium copper, and a lower portion 14 of a relatively low strength and inexpensive ductile metal, such as 190 alloy. The two portions 12 and 14 are mechanically and electrically connected along the seam 16 by means typically of continuous welding, such as electron beam welding. Stamped into upper portion 12 are cantilevered fingers 16 and 18 for contacting with the securing the leads of an electronic component.

The materials for portions 12 and 14 are chosen based on the design criterion and purposes of the lead socket assembly, and are selected based on such factors as conductivity, strength, resiliency, ductility and cost. In the preferred embodiment, it is desired to have resilient fingers to contact an inserted electrical component lead, while having a strong base where the lead socket assembly tail is soldered to the circuit board. Because resilient metals with good electrical conductivity are generally more expensive than are less resilient metals, one can use the present invention to avoid the use of larger quantities of the more expensive resilient metal than is necessary to achieve necessary performance characteristics.

Strips or layers of additional material may, if desired, be added to the composite metal strip to achieve additional benefits. In the preferred embodiment described herein, an inlaid fused strip of gold plate 20 is added to the upper composite metal 12 prior to stamping so that when the cantilevered fingers 16 and 18 are stamped into the upper portion 12, the gold strip 20 will be positioned on fingers 16 and 18 so as to make improved electrical contact with an electrical component lead inserted into the lead socket. A strip 22 of an anti-wicking material, such as aluminum, may also be added to the composite metal strip prior to stamping. This aluminum strip 22 is preferably attached to the lower composite metal 14 in any manner well-known in the art, and is positioned on the pre-stamped metal strip 14 so as to be located between the lead socket and the lead socket assembly tail 24, which tail will be inserted into and soldered to a printed circuit board. The anti-wicking material 22 prevents solder applied to lead socket assembly tail 24 from creeping into the lead socket and thus interfering with the cantilevered fingers 16 and 18 or the insertion of a component lead.

Figure 2:
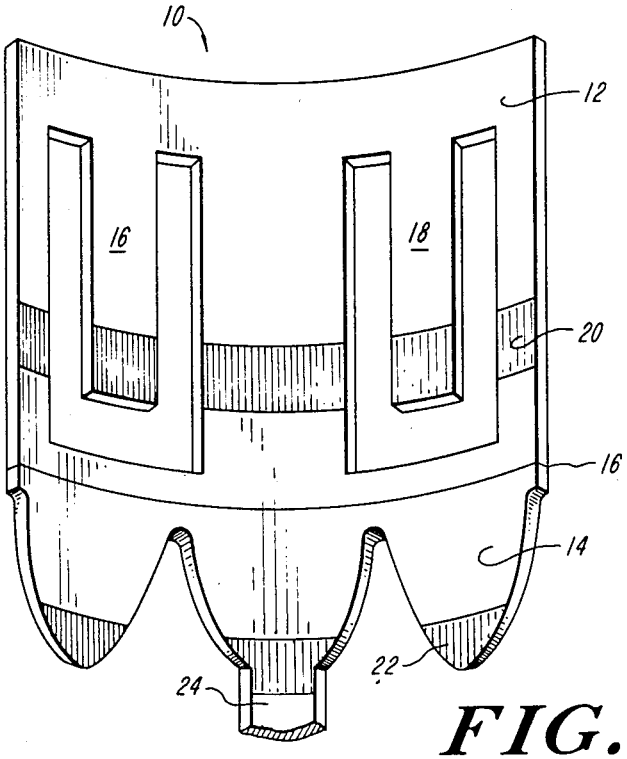
FIG. 2 is a perspective view of the lead socket assembly as it is begun to be formed.

After the lead socket assembly blank 10 is stamped from the composite metal strip, it is formed by methods well known in the industry by rolling it into the completed lead socket assembly. FIG. 2 depicts the stamped blank 10 in a partially rolled state.

Figure 3A:
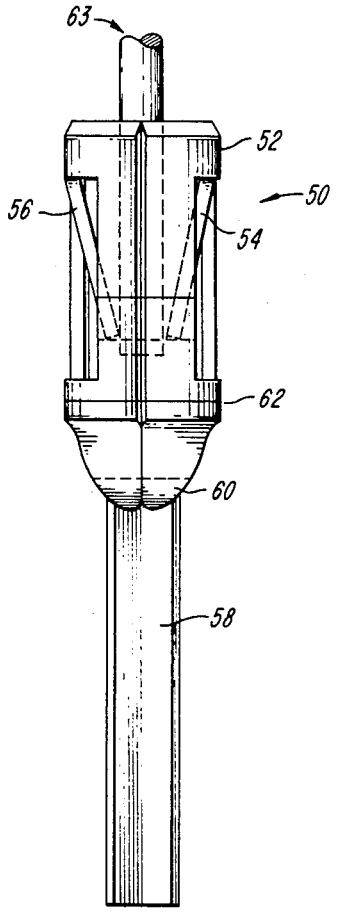
FIGS. 3A and 3B are orthogonal elevation views of lead socket assemblies incorporating the principles of this invention.
Figure 3B:
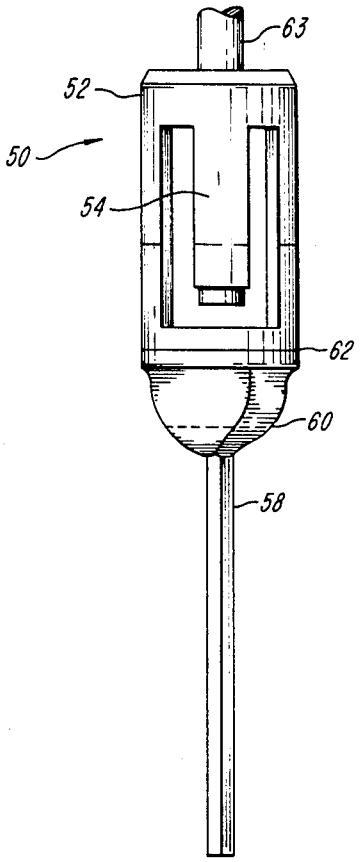

FIGS. 3A and 3B show a rolled and formed lead socket assembly 50 of the preferred embodiment of the presently disclosed invention. The lead socket assembly 50 comprises an upper cylindrical member 52 with two fingers 54 and 56 attached to it at their roots. It should be appreciated that the lead socket assembly need not be cylindrical, and that other shapes, such as triangular, will work equally as well. A lead socket assembly tail 58 extends from the cylindrical body 52. In the preferred embodiment, lead socket assembly tail 58 is V-shaped to add strength, since the contact material is typically only 5 to 7 mils thick. Fingers 54 and 56 are preferably designed to allow circuit components to be easily placed in and later removed from the lead sockets. Low insertion force is also desirable due to the large number of pins in a typical pin-grid array or other densely populated circuit component to be inserted. Around the base of cylindrical component 52 is located the anti-wick material 60.

The cylindrical component 52 is comprised of two metals welded along seam 62. The upper portion of the cylindrical member 52 is made of a resilient metal so that fingers 54 and 56 will have spring-like qualities. Below seam 62, the metal is chosen to be more ductile and less expensive. The tail of the lead socket assembly is strengthened by use of a V-notch or strength rib.

An electrical component lead 63 may be inserted into the lead socket in such a manner as to make good electrical and firm mechanical contact with fingers 54 and 56. In the preferred embodiment, the tips of fingers 54 and 56 are layered with a material to further improve electrical conductivity, such as gold plate.

Figure 4:
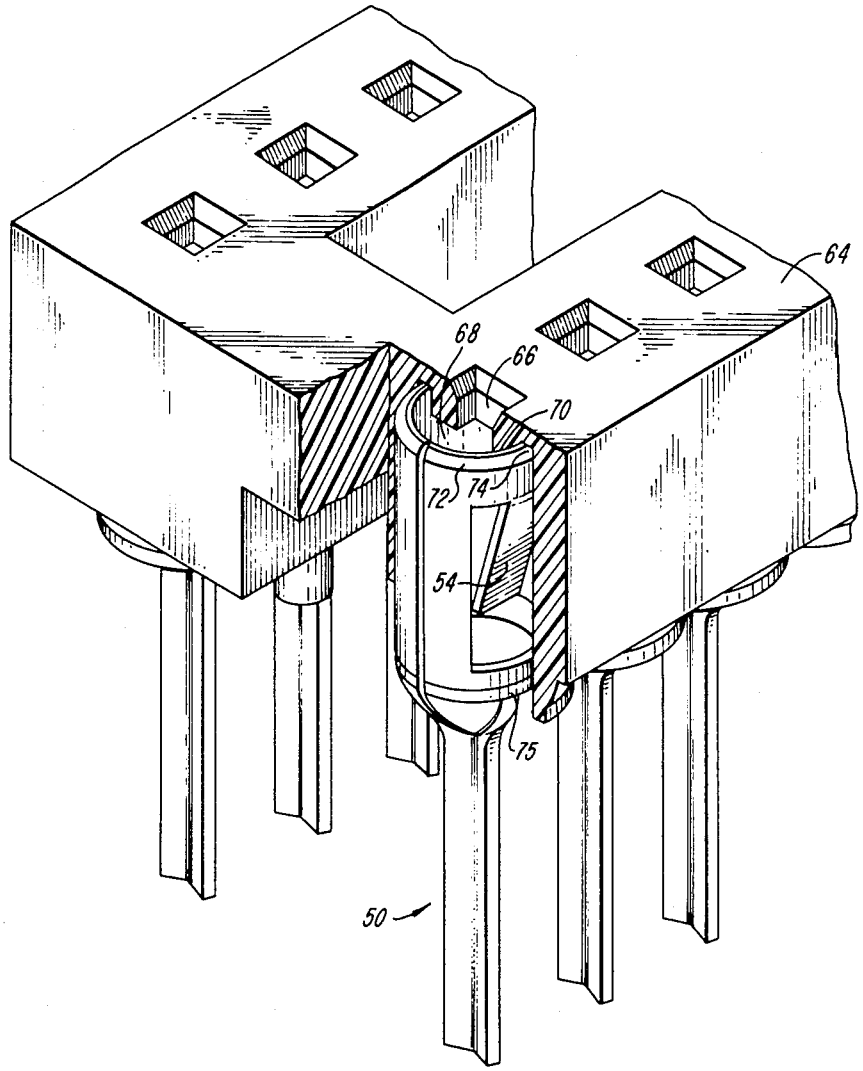
FIG. 4 is a partial segmented perspective view of the lead socket assembly of the present invention as incorporated into an integrated circuit socket.

FIG. 4 shows the lead socket assembly 50 mounted into an integrated circuit housing 64, which is of electrically insulating material. Housing 64 permits the lead socket assemblies to be readily centered in the receiving holes located in the printed circuit board. Openings for electronic component leads are provided in the housing 64 through a window hole 66 aligned with the socket opening 68 of the lead socket assembly 50 so that a component lead inserted into window 66 would be guided into the socket between cantilevered fingers 54 and 56. The edge 70 of housing 64 extends partially into socket opening 68, while the edge 72 of lead socket assembly 50 fits into a groove 74 located in the housing 64. The lead socket assembly 50 is retained in the housing 64 by heat sealing the ring 75 into engagement with the lower portion of the assembly.

The above-described invention is illustrative of a novel technique for manufacturing a lead socket assembly. It will be apparent that other modifications, embodiments and departures from the present disclosure are possible without departing from the inventive concept contained herein. Consequently, the invention is to be viewed as embracing each and every novel feature and novel combination of features present in or possessed by the technique herein disclosed, and are to be limited solely by the scope and spirit of the appended claims.

What is claimed:

1. A lead socket assembly comprising:

a generally tubular member with an open outer end adapted to receive a lead of an electronic component;

a contact member defining an electrical elongated lead tail for said electrical lead socket sufficiently strong to solder to a circuit board;

said tubular member including inwardly extending elements comprised of at least two fingers integrally connected to and cantilevered towards the center of said tubular member and operative to electrically and mechanically engage said lead of an electronic component inserted into said open end;

wherein at least the upper portion of said tubular member is comprised of at least a first homogeneous material having predetermined electrical and mechanical characteristics and wherein said tubular member is comprised of a material more resilient than said contact member;

wherein at least the lower portion of said contact member is comprised of a second homogeneous material having predetermined electrical and mechanical characteristics different from said first material and wherein said contact member is comprised of a material more ductile than said tubular member;

means for joining said generally tubular and contact members; and a strip of anti-wicking means located on the upper portion of said contact member.

2. The lead socket assembly of claim 1 wherein said contact member is a longitudinal lead axially parallel to said tubular member.

3. The lead socket assembly of claim 1 wherein the ends of said inwardly extending elements include a coating of a high conductivity material.

4. The lead socket assembly of claim 1 wherein said resilient metal is beryllium copper and said second and different metal is 190 alloy.

5. The lead socket assembly of claim 1 wherein said tubular member and said contact member are continuously joined around the circumference of said tubular member.

6. The lead socket assembly of claim 5 wherein said tubular and contact members are continuously welded together.

7. The lead socket assembly of claim 6 wherein said tubular and contact members are welded by electron beam welding.

8. The method of making a lead socket assembly comprising:

providing an elongated strip of metal having a first portion of a resilient homogeneous material and a second portion of a ductile homogeneous material, wherein said first and second portion are joined along the axis of said strip;

attaching a strip of material to said ductile section of said metal strip to create an anti-wicking barrier to substantially prevent solder from entering into the lead socket;

stamping a blank of predetermined form from said strip of metal; and forming said blank into a lead socket assembly comprising a generally tubular barrel with an open outer end adapted to receive a lead of an electronic component, and further comprising at least two inwardly extending elements operative to electrically and mechanically engage said lead of said electronic component;

said lead socket assembly further comprising an elongated lead tail for said lead socket assembly connected to said tubular barrel and sufficiently strong to solder to a circuit board;

whereby the upper portion of said barrel is comprised of said first material, and the lower portion of said means defining an electrical lead tail is comprised of said second material.

9. The method of claim 8 wherein the upper portion of said ductile portion is formed to provide additional mechanical support to said elongated lead tail.

10. The method of claim 8 wherein said first and second materials are joined by means of continuous welding.

11. The method of claim 10 wherein said first and second materials are joined by electron beam welding.

12. An electrical lead socket comprising:

a housing of insulative material having a plurality of cavities disposed in a predetermined manner to accommodate lead patterns of an integrated circuit chip;

each cavity communicating with an opening through one face of said housing through which the end of a circuit chip lead can be inserted;

the upper portion of said cavity comprising an edge and groove around said opening for receiving an electrical lead socket and further comprising a recessed lip to engage said electrical lead socket into a firm and locked position;

the lower portion of said cavity further comprising a circumferential ring heat sealable into engagement with the lower portion of an electrical lead socket to retain it in the housing;

wherein said electrical lead socket comprises:

a tubular portion of resilient metal with an open outer end adapted to receive a lead of an electronic component;

at least two contact fingers integral with said tubular portion, each extending into the tubular portion to allow electrical and mechanical contact with the lead of said electronic component when inserted into the tubular portion; and a longitudinal contact portion joined to said tubular portion and comprised of a ductile metal and containing a strip of anti-wicking means located on said contact portion.

* * * * *